US009200409B2

(12) United States Patent
Hartmann et al.

(10) Patent No.: US 9,200,409 B2
(45) Date of Patent: Dec. 1, 2015

(54) MULTILAYER COATING FOR PAPER BASED SUBSTRATE

(71) Applicant: Dow Global Technologies LLC, Midland, MI (US)

(72) Inventors: Julia F. Hartmann, Lachen (CH); Jouko T. Vyorykka, Richterswil (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/964,423

(22) Filed: Aug. 12, 2013

(65) Prior Publication Data

US 2013/0330527 A1 Dec. 12, 2013

Related U.S. Application Data

(63) Continuation of application No. 12/998,309, filed as application No. PCT/US2009/005474 on Oct. 6, 2009.

(60) Provisional application No. 61/195,843, filed on Oct. 10, 2008.

(51) Int. Cl.

| | |
|---|---|
| ***D21H 19/82*** | (2006.01) |
| *D21H 19/38* | (2006.01) |
| *D21H 19/40* | (2006.01) |
| *D21H 19/50* | (2006.01) |
| *D21H 19/54* | (2006.01) |
| *D21H 21/16* | (2006.01) |

(52) U.S. Cl.

CPC ..... *D21H 19/82* (2013.01); *D21H 19/385* (2013.01); *D21H 19/40* (2013.01); *D21H 19/50* (2013.01); *D21H 19/54* (2013.01); *D21H 21/16* (2013.01); *Y10T 428/24942* (2015.01); *Y10T 428/277* (2015.01)

(58) Field of Classification Search

USPC ..... 428/212, 342; 427/391

See application file for complete search history.

(56) References Cited

U.S. PATENT DOCUMENTS

| | | | |
|---|---|---|---|
| 4,468,498 | A | 8/1984 | Kowalski et al. |
| 5,760,121 | A | 6/1998 | Beall et al. |

(Continued)

FOREIGN PATENT DOCUMENTS

| | | |
|---|---|---|
| EP | 1296790 | 4/2003 |
| EP | 1358806 | 5/2003 |

(Continued)

OTHER PUBLICATIONS

Machine_English_Translation_JP_2005029941_A; Tanaka, Hideyuki, Greaseproof Treated Paper; Feb. 3, 2005; JPO; whole document.*

(Continued)

*Primary Examiner* — Tahseen N Khan

(74) *Attorney, Agent, or Firm* — Brooks, Cameron & Huebsch, PLLC

(57) ABSTRACT

Embodiments include a coated paper or paperboard with a multilayer coating and methods of forming a coated paper or paperboard with the multilayer coating. The multilayer coating includes a first water vapor barrier layer, a biopolymer barrier layer, and a second water vapor barrier layer and provides the paperboard with improved oil and grease resistant properties, oxygen barrier properties, and water vapor barrier properties.

18 Claims, 1 Drawing Sheet

(56) References Cited

U.S. PATENT DOCUMENTS

| | | | | |
|---|---|---|---|---|
| 6,569,539 | B2 | 5/2003 | Bentmar et al. | |
| 6,790,270 | B1 | 9/2004 | Billmers et al. | |
| 6,896,905 | B2 | 5/2005 | Blankenship et al. | |
| 6,911,255 | B2 | 6/2005 | Posey et al. | |
| 7,226,005 | B2 | 6/2007 | Jones et al. | |
| 7,241,832 | B2 | 7/2007 | Khemani et al. | |
| 7,244,505 | B2 | 7/2007 | Kippenhahn et al. | |
| 7,282,273 | B2 | 10/2007 | Murphy et al. | |
| 7,364,774 | B2 | 4/2008 | Urscheler et al. | |
| 7,425,246 | B2 | 9/2008 | Urscheler | |
| 7,608,668 | B2 | 10/2009 | Li Pi Shan et al. | |
| 2002/0127358 | A1* | 9/2002 | Berlin et al. | 428/36.6 |
| 2003/0188839 | A1 | 10/2003 | Urscheler | |
| 2003/0207038 | A1 | 11/2003 | Han et al. | |
| 2004/0115424 | A1 | 6/2004 | Cowton | |
| 2004/0121079 | A1 | 6/2004 | Urscheler et al. | |
| 2004/0121080 | A1 | 6/2004 | Urscheler et al. | |
| 2005/0039871 | A1 | 2/2005 | Urscheler et al. | |
| 2005/0042443 | A1 | 2/2005 | Miller | |
| 2005/0287248 | A1 | 12/2005 | Jabar, Jr. et al. | |
| 2006/0099410 | A1* | 5/2006 | Miller | 428/341 |
| 2007/0102129 | A1 | 5/2007 | Hwang et al. | |
| 2007/0184220 | A1 | 8/2007 | Cleveland et al. | |
| 2007/0232743 | A1 | 10/2007 | Laviolette et al. | |
| 2008/0311416 | A1* | 12/2008 | Kelly et al. | 428/537.5 |

FOREIGN PATENT DOCUMENTS

| | | | |
|---|---|---|---|
| EP | 1416087 | | 5/2004 |
| EP | 1416087 | A1 * | 5/2004 |
| EP | 1581388 | | 10/2005 |
| EP | 1733093 | | 12/2006 |
| GB | 2418380 | | 3/2006 |
| JP | 2005029941 | A * | 2/2005 |
| WO | 9747702 | | 12/1997 |
| WO | 2004035929 | | 4/2004 |
| WO | 2005014930 | | 2/2005 |
| WO | 2005044469 | | 5/2005 |
| WO | 2005090427 | | 9/2005 |
| WO | 2006002346 | | 1/2006 |
| WO | 2006042364 | | 4/2006 |
| WO | 2007008786 | | 1/2007 |

OTHER PUBLICATIONS

E. Bertoft, et al., "Structural Analysis on the Amylopectin of Waxy-Barley Large Starch Granules", J. Inst. Brew., vol. 98, September-October, 433-437.

S. Mali, et al., "Effects of Controlled Storage on Thermal, Mechanical, and Barrier Properties of Plasticized Films From Different Starch Sources", Journal of Food Engineering, No. 75, 2006, 453-460.

V. Alves, et al., "Effect of Glycerol and Amylose Enrichment on Cassava Starch Film Properties", Journal of Food Engineering, No. 78, 2007, 941-946.

R.K. Bharadwaj, "Modeling the Barrier Properties of Polymer-Layered Silicate Nanocomposites", Macromolecules, vol. 34, No. 26, 2001, 9189-9192.

R. Vaia, et al., "Lattice Model of Polymer Melt Intercalation in Organically-Modified Layered Silicates", Macromolecules, vol. 30, No. 25, 1997, 7990-7999.

C. Lu, et al., "Influence of Aspect Ratio on Barrier Properties of Polymer-Clay Nanocomposites", The American Physical Society, Physical Review Letter 95, week ending Aug. 19, 2005, pp. 088303-1 through 088303-4.

E. Gianazza, et al., "Amino Acid Composition of Zein Molecular Components", Phytochemistry, vol. 16, 1977, 315-317.

S. McGlashan, et al., "Preparation and Characterisation of Biodegradable Starch-Based Nanocomposite Materials", Polymer International, No. 52, 2003, 1767-1773.

H. Wilhelm, et al., "The Influence of Layered Compounds on the Properties of Starch/layered Compound Composites", Polymer International, No. 52, 2003, 1035-1044.

R. Gross, et al., "Biodegradable Polymers for the Environment", Science, vol. 297, Aug. 2, 2002, 803-807.

A. Sorrentino, et al., "Potential Perspectives of Bio-Nanocomposites for Food Packaging Applications", Trends in Food Science & Technology, No. 18, 2007, 84-95.

S. Huang, "Poly(Lactic Acid) and Copolyesters" Handbook of Biodegradable Polymers, Smithers Rapra Technology, 2005, 287-301.

T. Kawakita, "Proteins: Amino Acids", Wiley Encyclopedia of Food Science and Technology (2nd Edition), Editor, Frederick J. Francis, John Wiley & Sons, New York, N.Y, 1999, 1988-2000.

R. Yada, et al., "Proteins: Denaturation and Food Processing", Wiley Encyclopedia of Food Science and Technology (2nd Edition), Editor, Frederick J. Francis, John Wiley & Sons, New York, N.Y, 1999, 2000-2014.

Bohlmann, "Chapter 6: General Characteristics, Processability, Industrial Applications and Market Evolution of Biodegradable Polymers", Handbook of Biodegradable Polymers, Smithers Rapra Technology, 2005, 183-217.

Arvanitoyannis, et al., "Chapter 2: Starch-Cellulose Blends", Biodegradable Polymer Blends and Composites from Renewable Resources, John Wiley & Sons, Inc., 2009, 19-39.

Yu, et al., "Chapter 1: Polymeric Materials from Renewable Resources", Biodegradable Polymer Blends and Composites from Renewable Resources, John Wiley & Sons, Inc., 2009, 1-15.

Fischer, et al., "Chapter 15: Starch-Based Nanocomposites Using Layered Minerals", Biodegradable Polymer Blends and Composites from Renewable Resources, John Wiley & Sons, Inc., 2009, 369-388.

Guilbert, et al., "Chapter 11: Materials Formed From Proteins", Handbook of Biodegradable Polymers, Smithers Rapra Technology, 2005, 339-384.

Bastioli, "Chapter 8: Starch Based Technology", Handbook of Biodegradable Polymers, Smithers Rapra Technology, 2005, 257-286.

Second SustainPack Conference: "Radically changing fibre-based packaging through innovation, nanotechnology, and sustainable development", Conference Promotional Program/Schedule/Literature, Dec. 4-6, 2006, 6 pages.

Hartmann, et al. "Multilayer Curtain Coating: Sustainable Barrier Coatings With Biopolymers", presented at: 17th International Munich Paper Symposium, Apr. 3, 2008, 35 pages.

Definition of "binder" at p. 122 of Merriam Webster's Collegiate Dictionary, Eleventh Edition, Merriam-Webster, Inc., Springfield, Mass.(2003)(3 pages).

International Search Report and Written Opinion from related PCT Application PCT/US2009/005474 dated May 1, 2010, (15 pages).

International Preliminary Report on Patentability from related PCT Application PCT/US2009/005474 dated Apr. 21, 2011, (9 pages).

Schoenweitz C., Schmidt M., "Mulitlayer barrier coatings based on biopolymers", Sustainpack Conference, Barcelona, Dec. 4-5, 2006, 35 pages.

P. Forssell, et al., "Oxygen permeability of amylose and amylopectin films", Carbohydrate Polymers, No. 47, 2002 125-129.

E.P. Giannelis, "Polymer Layered Silicate Nanocomposites", Advanced Materials, vol. 8, No. 1, 1996, 29-35.

M. Zanetti, et al., "Polymer layered silicate nanocomposites", Macromolecular Materials and Engineering, No. 279, 2000, 1-9.

H.M. Park, et al., "Preparation and Properties of Biodegradable Thermoplastic Starch/Clay Hybrids", Macromolecular Materials and Engineering, vol. 287, No. 8, 2002, 553-558.

S. Gaudin, et al., "Plasticisation and Mobiliy in Starch-Sorbitol Films", Journal of Cereal Science, No. 29, 1999, 273-284.

S. Gaudin, et al., "Antiplasticization and oxygen permeability of starch-Sorbitol films", Carbohydrate Polymers, No. 43, 2000, 33-37.

B. Xu, et al,, "Calculating barrier properties of polymer/clay nanocomposites: Effects of clay layers", Polymer, No. 47, 2006, 2904-2910.

D. Benczédi, "Estimation of the free volume of starch-water barriers" Trends in Food Science & Technology, No. 10, 1999, 21-24.

P. Dole, et al., "Gas transport properties of starch based films", Carbohydrate Polymers, No. 58, 2004, 335-343.

De Carvalho, et al., "A first insight on composites of thermoplastic starch and kaolin", Carbohydrate Polymers, No. 45, 2001, 189-194.

L. Godbillot, et al., "Analysis of water binding in starch plasticized films", Food Chemistry, No. 96, 2006, 380-386.

(56) References Cited

OTHER PUBLICATIONS

E. Gianazza, "Amino acid composition of zein molecular components", Phytochemistry, vol. 16, 1977, 315-317.
H. Moller, et al., "Antimicrobial and Physicochemical Properties of Chitosan-HPMC-Based Films", J. Agric. Food Chem, No. 52, 2004, 6585-6591.
Avena-Bustillos, et al., "Barrier and Mechanical Properties of Fish Gelatin Films", 2006, Abstracts of Papers, 232nd ACS National Meeting, San Francisco, CA, United States, 1 page.
H. Kjellgren, et al., "Barrier and surface properties of chitosan-coated greaseproof paper", Carbohydrate Polymers, No. 65, 2006, 453-460.
T. Scherzer, "Barrier layers against oxygen transmission on the basis of electron beam cured methacrylated gelatin", Nuclear Instruments and Methods in Physics Research B, No. 131, 1997, 382-391.
R. Chandra, et al. "Biodegradable Polymers", Progress in Polymer Science, vol. 23, 1998, 1273-1335.
L Petersson, et al., "Biopolymer based nanocomposites: Comparing layered silicates and microcrystalline cellulose as nanoreinforcement", Composites Science and Technology, No. 66, 2006, 2187-2196.
N. Parris, et al., "Composition Factors Affecting the Water Vapor permeability and Tensile properties of Hydrophilic Zein Films", J. Agric. Food Chem., No. 45, 1997, 1596-1599.
N. Parris, et al., "Enzymatic Hydrolysis, Grease permeation and Water barrier properties of Zein Isolate Coated Paper", J. agric. Food Chem., No. 48, 2000, 890-894.
A. Gennadios, et al., "Effect of pH on Properties of Wheat Gluten and Soy Protein Isolate Films", J. Argic. Food Chem., No. 41, 1993,1835-1839.
A. Gennadios, et al., "Water vapor permeability of wheat gluten and soy protein isolate films", Industrial Corps and Products 2, 1994, 189-195.
F. Ham-Pichavant, et. al., Fat resistance properties of Chitosan-based paper packaging for food applications, Carbohydrate Polymers, No. 61, 2005, 259-265.
N. Gontard, Films comestible et biodegradables: etude des proprietes filmogenes du gluten de ble, Comptes Rendus de L'Academie d'Agriculture de France, No. 80(4), 1994, 109-117.
P. Zamudio, et al., Films Prepared with Oxidized Banana Starch: Mechanical and Barrier Properties, WILEY-VCH Verlag GmbH & Co. KGaA, Starch/Stärke No. 58, 2006, 274-282.
F. Shahidi, et al., Food applications of chitin and Chitosans, Trends in Food Science and Technology, No. 10 (2), 1999, 37-51.
Gelita, "Gelatin Production", 2003, The Gelatin Group,www.GELITA.com,12 pages.
Jong-Whn Rhim, et al., "Increase in Water Resistance of Paperboard by Coating with Poly(lactide)", 2007, Packaging Technology and Science (in press), published online in Wiley InterScience, www.interscience.wiley.com, 10 pages.
S. Guilbert, et al., "Material Formed from Proteins", Handbook of Biodegradable Polymers, 2005, 339-384.
A. Gennadios, et al., "Modification of Physical and Barrier Properties of Edible Wheat Gluten-Based Films", Cereal Chemistry, No. 70 (4), 1993, 426-429.
S. Ray, et al., "New polylactide-layered silicate nanocomposites.2. Current improvements of material properties, biodegradability and melt rheology", Polymer 44, 2003, 857-866.
S. Ray, et al. "New polylactide/layered silicate nanocomposites.5. Designing of materials with desired properties", Polymer 44, 2003, 6633-6646.
S. Ray, et al., "Polymer/layered silicate nanocomposites: a review from preparation to processing", Progress in Polymer Science, No. 28, 2003, 1539-1641.
M. Gallstedt, et al., "Packaging-related Properties of Protein- and Chitosan-coated Paper", Packaging Technology and Science, No. 18, 2005, 161-170.
S. Hollmach, "Gelatin—ein vielseitiges Biopolymer. Herstellung, Anwendung und chemische Modifikationen" 2000, 15 pages.
M.I. Beck, et al., "Physico-chemical characterization of zein as a film coating polymer. A direct comparison with ethyl cellulose", International Journal of Pharmaceutics, No. 141, 1996, 137-150.
T. Ghosh, "Practical Aspects of Water Based Barrier Coatings (WBBC's) for Paper / Board Applications", 2nd SustainPack Conference, Barcelona Spain, Dec. 5, 2006, 57 pages.
M. Garcia, et al., "Physiochemical, Water Vapor Barrier and Mechanical Properties of Corn Starch and Chitosan Composite Films", Starch/Stärke No. 58, 2006, 453-463.
M. Pommet, et al., "Study of wheat gluten plasticization with fatty acids", Polymer 44, 2003, 115-122.
S. Roy, et al., "Water vapor transport parameters of a cast wheat gluten film", Industrial Corps and Products, No. 11, 2000, 43-50.
J. Lawton, "Zein: A History of Processing and Use", Cereal Chemistry vol. 79(1), 2002, 1-18.
B. Chen, et al., "Thermoplastic starch-clay nanocomposites and their characteristics", Carbohydrate polymers 61, 2005, 455-463.
Mocon, OX-TRAM Model 2/21 Operator's Manual, Revision C, 2002, www.mocon.com, 6 pages.
L. Jarnstrom, "Water based barrier coatings", 2nd SustainPack conference, Barcelona, Spain, 2006, 1-38.
B. Cole, "Gelatin", Encyclopedia of Food Science and Technology, 2nd edition, vol. 4, New York: John Wiley & Sons, 2000, 1183-1188.
E.P. Giannelis, "Polymer-Layered Silicate Nanocomposites: Synthesis, Properties, and Applications", Applied Organometallic Chemistry, No. 12, 1998, 675-680.
Krishnamoorti et al., "Structure and Dynamics of Polymer-Layered Silicate Nanocomposites", Chem. Mater., No. 8, 1996, 1728-1734.

* cited by examiner

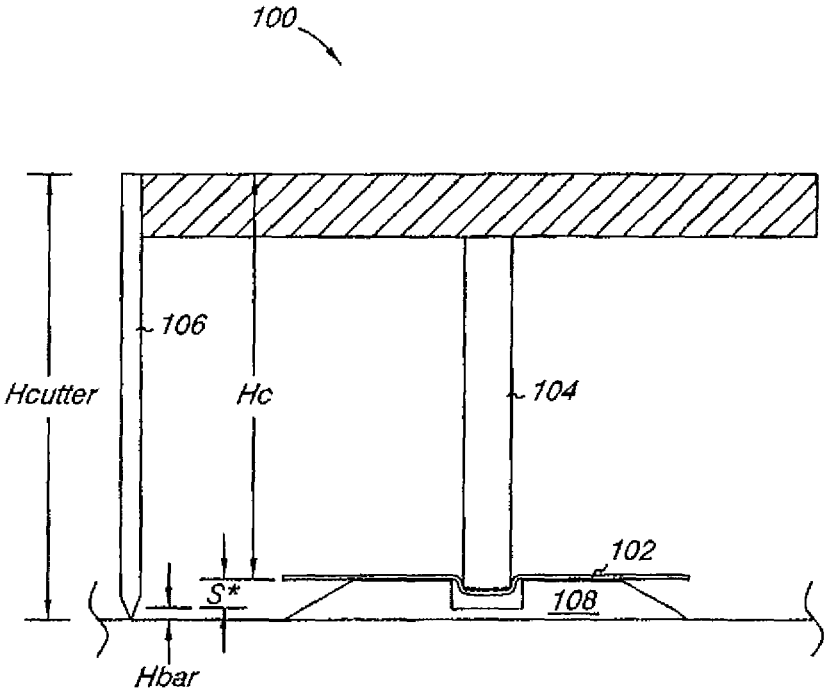
100
106
Hcutter
Hc
104
102
S*
108
Hbar

MULTILAYER COATING FOR PAPER BASED SUBSTRATE

CROSS REFERENCE TO RELATED SUBJECT MATTER

This application is a Divisional application of U.S. patent application Ser. No. 12/998,309, filed Apr. 7, 2011, which is a U.S. National Stage Application under 35 U.S.C. of PCT/US2009/005474, filed Oct. 6, 2009, and published as WO 2010/042162 on Apr. 15, 2010, which claims the benefit of U.S. Provisional Application Ser. No. 61/195,843, filed Oct. 10, 2008, the entire contents of which are incorporated herein by reference.

FIELD OF DISCLOSURE

The present disclosure generally relates to coated paper or paperboard, and particularly to coated paper or paperboard having a multilayer coating for oil and grease resistance properties, oxygen barrier properties, and water vapor barrier properties.

BACKGROUND

Fibrous substrates, such as paper and paperboard, are widely used in packaging operations. However, paper and paperboard can have very poor resistance to penetration by, for example, water vapor, gases, oils, solvents, and greases. To improve the resistance to penetration by such substances, paper and paperboard have been coated with a variety of materials. For many years, treatments with fluorochemicals, either by surface treatment or as a wet end additive in the paper making process, have been the dominant approach used to achieve oil and grease resistance (OGR) properties. Recent environmental concerns surrounding fluorochemicals, however, have prompted paper and paperboard manufacturers to search for alternative approaches to coating compositions that impart OGR properties to the coated paper.

Alternative approaches to impart OGR properties to coated paper have included using agents such as latexes, gelatins, starches, modified starches, and vegetable proteins. These agents, however, have been used in expensively large amounts in order to impart sufficient OGR properties. In addition, the use of such large amounts of these agents can result in treated paper and paperboard that is too stiff and/or brittle for many uses. As such, the coating materials can cause the coatings formed to fail when the coated paperboard or paper is creased and/or folded.

One approach to address the stiffness and/or brittleness of the coatings has been to incorporate high amounts of plasticizers into the coatings. While high amounts of plasticizer can help to increase the flexibility of the coatings, the high amounts of plasticizer can also result in a loss of oxygen barrier properties and a decrease in resistance to water vapor penetration, making the paper coatings ineffective for their intended purpose.

Accordingly, there is a continuing need for paper coatings that provide flexible barrier coatings on fibrous substrates having improved resistance to penetration by oil, grease, solvent, oxygen, and water vapor.

SUMMARY

The present disclosure provides embodiments of a coated paper or paperboard in which a base paper has been coated with a multilayer coating, and a method of forming the coated paper or paperboard. For the various embodiments, the multilayer coating of the coated paper or paperboard includes water vapor barrier layers that sandwich biopolymer barrier layers. For the various embodiments, the structure of the multilayer coating provides the coated paper or paperboard with improved oil and grease resistance (OGR) properties, oxygen barrier properties, and water vapor barrier properties. Surprisingly, the multilayer coating on the coated paper or paperboard also maintains its OGR properties even after the application of mechanical stress through creasing and/or folding of the coated paper or paperboard.

For the various embodiments, the coated paper or paperboard includes a base paper with the multilayer coating having a total dry coat weight of 10 grams per meter squared ($g/m^2$) or less over a first major surface. The multilayer coating is configured to have a first water vapor barrier layer, a biopolymer barrier layer on the first water vapor barrier layer, and a second water vapor barrier layer on the biopolymer barrier layer. In addition, the biopolymer barrier layer has a dry coat weight of 4 $g/m^2$ or less. Other layers can also be included in the multilayer coating.

In additional embodiments, the multilayer coating can be configured to have a first water vapor barrier layer, a first biopolymer barrier layer on the first water vapor barrier layer, a second biopolymer barrier layer on the first biopolymer barrier layer, and a second water vapor barrier layer on the second biopolymer barrier layer, where the first biopolymer barrier layer and the second biopolymer barrier layer are between the first water vapor barrier layer and the second water vapor barrier layer. Also, each of the first biopolymer barrier layer and the second biopolymer barrier layer have a dry coat weight of 2 $g/m^2$ or less.

For the various embodiments, the biopolymer barrier layer can include a biopolymer, a plasticizer, and a pigment. In some embodiments, the amount of plasticizer can be kept relatively low as compared to conventional coatings that include high levels of plasticizer in order to increase the flexibility of the coatings.

The various embodiments also include a method of forming the coated paper or paper board of the present disclosure that includes simultaneously applying a multilayer coating to a first major surface of a base paper and drying the multilayer coating on the first major surface of the base paper. The multilayer coating includes: a first water vapor barrier layer and a second water vapor barrier layer each formed from a first coating composition that is formed with a latex. The multilayer coating also includes at least one biopolymer barrier layer formed from a second coating composition that includes a biopolymer, about 2.5 to about 50 weight parts of a plasticizer for every 100 dry weight parts of biopolymer, and about 10 to about 100 weight parts of a pigment for every 100 dry weight parts of biopolymer. In addition, the biopolymer barrier layer is positioned between the first and second barrier layers.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DEFINITIONS

As used herein, "a," "an," "the," "at least one," and "one or more" are used interchangeably. The terms "includes" and "comprises" and variations thereof do not have a limiting meaning where these terms appear in the description and claims. Thus, for example, a biopolymer barrier layer that includes "a" biopolymer can be interpreted to mean that the layer includes "one or more" biopolymers.

The term "and/or" means one, one or more, or all of the listed elements.

Also herein, the recitations of numerical ranges by endpoints include all numbers subsumed within that range (e.g., about 1 to about 5 includes 1, 1.5, 2, 2.75, 3, 3.80, 4, 5, etc.).

As used herein, the term "dry" means a substantial absence of liquids.

As used herein, the term "dry weight" refers to a weight of a dry material. For example, the solids content of the clay can be expressed as a dry weight, meaning that it is the weight of clay remaining after essentially all volatile materials (e.g., water) have been removed.

As used herein, "room temperature" refers to an ambient temperature of about 20° C. to about 25° C.

As used herein, the term "parts" refers to parts per 100 weight parts of a total dry weight of one or more solids of the coating composition.

As used herein, an "aspect ratio" is a ratio of a longest dimension along a first axis of an individual piece of a clay to a shortest dimension along a second axis of the clay.

As used herein, "paper" and "paperboard" refers to a paper based substrate of an amalgamation of fibers that can include, at least in part, vegetable, wood, and/or synthetic fibers. As used herein, "fiberboard" refers to a material made by compressing fibers (such as those discussed herein) into sheets that are stiffer than either paper and/or paperboard. As appreciated, other components can be included in the paper based substrate of the paper and/or paperboard and/or the sheet of the fiberboard. The paper, paperboard, and/or fiberboard, as used herein, differ in their thickness, stiffness, strength, and/or weight, but are intended to be modified by the embodiments of the coating compositions and methods provided herein to form the coated paper based substrate of the present disclosure. For the present disclosure, the term "paper based substrate" encompasses and is interchangeable with the terms "paper," "paperboard," and "fiberboard" unless such a construction is clearly not intended, as will be clear from the context in which this term is used.

As used herein, "latex" refers to an aqueous suspension of polymers, which can be natural polymers, synthetic polymers, or combinations thereof.

As used herein, "biopolymer" refers to a polymeric substance derived from a biological source. As used herein, "biopolymer" refers to a group consisting of a starch, a chitosan, a polysaccharide, a protein, a gelatin, a biopolyesters and modifications and mixtures thereof.

As used herein, the term "composition" or "coating composition" is interpreted to include true liquid solutions, as well as colloidal dispersions, suspensions, emulsions, and latexes as they are conventionally defined.

As used herein, "exfoliation" refers to a process of breaking up and separating layered fillers into individual layers of the original particle.

As used herein, "mechanical stress" refers to creasing, folding, bending, rolling, and pressing paper.

As used herein, "specific surface area" refers to the total surface area per unit of mass, solid or bulk volume, or cross-sectional area of a material.

BRIEF DESCRIPTION OF THE DRAWINGS

FIG. 1 illustrates one embodiment of a lab creasing device used in forming crease coated base paper samples according to the present disclosure.

DETAILED DESCRIPTION

Embodiments of the present disclosure provide for a coated paperboard with a multilayer coating that provides the paperboard with improved oil and grease resistance (OGR) properties and oxygen barrier properties. The term "paperboard" is used herein, however one skilled in the art will appreciate that embodiments of the present disclosure can be used with paper and/or paperboard. In addition, as discussed herein, the multilayer coating provides the paperboard with water vapor resistance as well as improved OGR properties and oxygen barrier properties.

For the various embodiments, the multilayer coating of the present disclosure includes a first water vapor barrier layer, a biopolymer barrier layer, and a second water vapor barrier layer. In various embodiments, the biopolymer barrier layer can be formed of two or more separate layers.

For the various embodiments, the method for preparing the coated paperboard includes providing the paperboard (i.e., base paper) having a first major surface and simultaneously applying a multilayer coating to the first major surface of the paperboard. As discussed herein, the multilayer coating includes a first water vapor barrier layer and a second water vapor barrier layer each formed from a first coating composition including a latex. The multilayer coating further includes at least one biopolymer barrier layer formed from a second coating composition that includes a biopolymer, about 2.5 to about 50 weight parts of a plasticizer for every 100 dry weight parts of biopolymer, and about 10 to about 100 weight parts of a pigment for every 100 dry weight parts of biopolymer. For the various embodiments, the biopolymer barrier layer is positioned between the first and second barrier layers. For the various embodiments, once applied to the paperboard, the multilayer coating is dried on the first major surface of the paperboard.

The first and second coating compositions of the multilayer coating can be applied to the paperboard to form a coating of a desired thickness and/or dry coat weight of the first water vapor barrier layer, the biopolymer barrier layer(s), and the second water vapor barrier layer by using known paper or paperboard coating techniques. Such techniques include, but are not limited to, multilayer curtain coating methods for the simultaneous coating of multiple layers as are described in WO 2004/035929, US 2003/0188839, and US 2004/0121080, which are incorporated herein in their entirety.

As discussed herein, the first and second water vapor barrier layers can be provided on each side of the biopolymer barrier layer. For example, the first water vapor barrier layer can be disposed on the surface of the paperboard, the biopolymer barrier layer can be disposed on the first water vapor barrier layer, and then the second water vapor barrier layer can be disposed on the biopolymer barrier layer. In other words, the first and second water vapor barrier layers can sandwich the biopolymer barrier layer. In addition, as discussed further herein, in various embodiments, the biopolymer barrier layer can consist of more than one biopolymer barrier layer.

The water vapor barrier layers formed from the first coating composition of the present disclosure can provide water vapor resistance to the paperboard and protect the biopolymer barrier layer from water absorption. For the various embodiments, the dry coat weight for each water vapor barrier layer can be in the range of 1 gram per square meter ($g/m^2$) to 10 $g/m^2$. For example, in some embodiments the dry coat weight for each water vapor barrier layer can be 3 $g/m^2$ or less, so that the first water vapor barrier layer and the second water vapor barrier layer can have a combined dry coat weight of 6 $g/m^2$ or less. In other embodiments, the dry coat weight for each water vapor barrier layer can be 5 $g/m^2$ or less. Other dry coat weights are also possible. Furthermore, the first water vapor barrier layer and the second water vapor barrier layer can have different dry coat weights with respect to each other.

In various embodiments, the first coating composition of the biopolymer barrier layer can be applied in one layer to provide a total dry coat weight of 4 $g/m^2$ or less. In other embodiments, the first coating composition of the biopolymer barrier layer can be applied in at least two layers, for example, a first biopolymer barrier layer and a second biopolymer barrier layer. In the embodiments where the biopolymer barrier layer is applied in two layers, the first biopolymer barrier layer and the second biopolymer barrier layer can each have a dry coat weight of 2 $g/m^2$ or less. In other embodiments, the first biopolymer barrier layer and second biopolymer barrier layer can each have a dry coat weight of 1 $g/m^2$ or less. In an additional embodiment, the first biopolymer barrier layer and second biopolymer barrier layer can each have a dry coat weight of about 0.5 $g/m^2$ or less. In addition, the biopolymer barrier layer can include the first and second biopolymer barrier layers having different dry coat weights. For example, the first biopolymer barrier layer can have a dry coat weight of about 2 $g/m^2$ while the second biopolymer barrier layer has a dry coat weight of about 0.5 $g/m^2$. Other dry coat weight combinations are also possible.

As discussed above, the first and second coating compositions of the multilayer coating of the present disclosure can be applied on the paperboard to provide various thicknesses and/or dry coat weights. Thus, for example, the multilayer coating can have a total dry coat weight of 10 $g/m^2$ or less, where the first water vapor barrier layer may be applied to produce a dry coat weight of 3 $g/m^2$ or less, a first biopolymer barrier layer can be applied to produce a dry coat weight of 2 $g/m^2$ or less, a second biopolymer barrier layer can be applied to produce a dry coat weight of 2 $g/m^2$ or less, and a second water vapor barrier layer can be applied to produce a dry coat weight of 3 $g/m^2$ or less.

In an alternative embodiment, the first coating composition can be applied to produce a first water vapor barrier layer having a dry coat weight of 3 $g/m^2$ or less, the second coating composition can be applied as a single layer to produce a biopolymer barrier layer having a dry coat weight of 4 $g/m^2$ or less, and the first coating composition can be applied to produce a second water vapor barrier layer having a dry coat weight of 3 $g/m^2$ or less.

Unlike embodiments of the prior art, the multilayer coating of the present disclosure includes a thin biopolymer barrier layer that can provide OGR properties and oxygen barrier properties, where the OGR properties can be retained after the paperboard has been exposed to mechanical stress. For example, as discussed more fully herein, the dried coating on the paperboard can provide an OGR barrier that has a flat Kit Rating Number of 12. As discussed herein, the Kit Rating Number is a metric given to indicate how well a surface (such as the surface of the dried coating of the coated paperboard) resists penetration by a series of reagents of increasing aggressiveness.

The multilayer coating of the present disclosure can also provide an oxygen permeability of no more than 100 cubic centimeters per meters squared ($cm^3/m^2$) a day at 23 degrees Celsius (° C.), 760 millimeters mercury (mmHg), and 50 percent relative humidity. These results are more fully discussed herein in the Examples section.

Additionally, a Hot Oil Circle Test can be used to illustrate that the multilayer coating of the present disclosure can prevent penetration of canola oil at 60° C. for 24 hours through the multilayer coating and into the paperboard after exposing the coated paperboard to mechanical stress. As discussed herein, the Hot Oil Circle Test is a method to evaluate the hot-oil resistance of paper coatings.

As discussed herein, the water vapor barrier layers (e.g., the first and second water vapor barrier layers) can surround the biopolymer barrier layer and protect the biopolymer barrier layer and the paperboard from water penetration. For the various embodiments, the water vapor barrier layers can be formed from a latex and an emulsifying agent. For the various embodiments, the latex can be present in the water vapor barrier layer in an amount ranging from about 30 percent to about 100 percent of the total weight of the water vapor barrier layer. For the various embodiments, the emulsifying agent can be present in the water vapor barrier layer in a range of about 0.1 to about 2.5 weight parts based on every 100 dry weight parts of latex.

For the various embodiments, latexes that provide for good film formation without tackiness or stickiness are preferred. Examples of such latexes for use in the first coating composition can be selected from a group consisting of styrene-butadiene latexes, styrene-acrylate latexes, styrene-acrylic latexes, styrene maleic anhydrides, styrene-butadiene acrylonitrile latexes, styrene-acrylate-vinyl acrylonitrile latexes, vinyl acetate latexes, vinyl acetate-butyl acrylate latexes, vinyl acetate-ethylene latexes, acrylic latexes, vinyl acetate-acrylate latexes, acrylate copolymers, vinylidene-containing latexes, vinylidene chloride/vinyl chloride containing latexes and a mixtures thereof. Carboxylated versions of several of the above latexes are also possible, where the latexes are prepared by copolymerizing the monomers with a carboxylic acid such as, for example, acrylic acid, methacrylic acid, itaconic acid, maleic acid, fumaric acid etc. Other possible latexes for use in the first coating composition can also include those latexes described in U.S. Pat. Nos. 4,468,498 and 6,896,905, incorporated herein by reference.

In addition to the latexes mentioned above, the first coating composition used to form the water vapor barrier layer can include polysaccharides, proteins, polyvinyl pyrrolidone, polyvinyl alcohol, polyvinyl acetate, cellulose and cellulose derivatives, epoxyacrylates, polyester, polyesteracrylates, polyurethanes, polyetheracrylates, oleoresins, nitrocellulose, polyamide, vinyl copolymers, various forms of polyacrylates, and copolymers of vinyl acetate, (meth)acrylic acid and vinyl versatate. Further, the coating composition of the present disclosure can further include at least one or more base polymers selected from the group of thermoplastic resins including homopolymers and copolymers (including elastomers) of an alpha-olefin such as ethylene, propylene, 1-butene, 3-methyl-1-butane, 4-methyl-1-pentene, 3-methyl-1-pentene, 1-heptene, 1-hexene, 1-octene, 1-decene, and 1-dodecene as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butane copolymer, and propylene-1-butene copolymer; copolymers (including elastomers) of an alpha-olefin with a conjugated or non-conjugated diene as typically represented by ethylene-butadiene copolymer and ethylene-ethylidene norbornene copolymer; and polyolefins (including elastomers) such as copolymers of two or more I alpha-olefins with a conjugated or non-conjugated diene as typically represented by ethylene-propylene-butadiene copolymer, ethylene-propylene-dicyclopentadiene copolymer, ethylene-propylene-1,5-hexadiene copolymer, and ethylene-propylene ethylidene norbornene copolymer; ethylene-vinyl compound copolymers such as ethylene-vinyl acetate copolymer, ethylene-vinyl alcohol copolymer, ethylene-vinyl chloride copolymer, ethylene acrylic acid or ethylene-(meth)acrylic acid copolymers, and ethylene-(meth) acrylate copolymer; styrenic copolymers (including elastomers) such as polystyrene, ABS, acrylonitrile-styrene copolymer, ot-methylstyrene-styrene copolymer; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like. These resins may be used either alone or in combinations of two or more. Additionally, olefin block copolymers, such as those described in International Patent Application No. WO 2005/090427 and U.S. patent application Ser. No. 11/376,835, may also be used as a base polymer. As used herein, the term "copolymer" refers to a polymer formed of two or more comonomers.

In particular embodiments, polyolefins such as polypropylene, polyethylene, copolymers thereof, and blends thereof, as well as ethylene-propylene-diene terpolymers can be the base polymer included in the coating composition. The coating composition can also include at least one or more stabilizing agent and a fluid medium for forming the coating composition.

For the various embodiments, the emulsifier included in the first coating composition to form the water vapor barrier layer can be an anionic emulsifier. Suitable anionic emulsifiers include the alkyl aryl sulfonates, alkali metal alkyl sulfates, the sulfonated alkyl esters, and fatty acid soaps. Specific examples include sodium dodecylbenzene sulfonate, sodium butylnaphthalene sulfonate, sodium lauryl sulfate, disodium dodecyl diphenyl ether disulfonate, N-octadecyl sulfosuccinate and dioctyl sodiumsulfosuccinate.

The emulsifier can also be nonionic. Suitable nonionic emulsifiers include polyoxyethylene condensates. Exemplary polyoxyethylene condensates that can be used include polyoxyethylene aliphatic ethers, such as polyoxyethylene lauryl ether and polyoxyethylene oleyl ether; polyoxyethylene alkaryl ethers, such as polyoxyethylene nonylphenol ether and polyoxyethylene octylphenol ether; polyoxyethylene esters of higher fatty acids, such as polyoxyethylene laurate and polyoxyethylene oleate, as well as condensates of ethylene oxide with resin acids and tall oil acids; polyoxyethylene amide and amine condensates such as N-polyoxyethylene lauramide, and N-lauryl-N-polyoxyethylene amine and the like; and polyoxyethylene thio-ethers such as polyoxyethylene n-dodecyl thio-ether.

Various protective colloids may also be used in place of emulsifying or stabilizing agents in the first coating composition used to form the water vapor barrier layers. Suitable colloids include casein, hydroxyethyl starch, carboxyxethyl cellulose, carboxymethyl cellulose, hydroxyethylcellulose, gum arabic, alginate, poly(vinyl alcohol), polyacrylates, polymethacrylates, styrene-maleic anhydride copolymers, polyvinylpyrrolidones, polyacrylamides, polyethers, and the like, as known in the art of emulsion polymerization technology. In general, when used, these colloids are used at levels of 0.05 percent to 10 percent by weight based on the total weight of the emulsion polymerization reactor contents.

The water vapor barrier layers can also include a pigment, where each of the first water vapor barrier layer and the second water vapor barrier layer can have about 0 to about 100 weight parts pigment for every 100 dry weight parts of latex. For the various embodiments, the pigment used in the water vapor barrier layer can be selected from a group consisting of clay, calcined clay, an exfoliated natural layered silicate, a partially exfoliated natural layered silicate, exfoliated synthetic layered silicate, a partially exfoliated synthetic layered silicate, ground calcium carbonate, precipitated calcium carbonate, calcium sulphate, aluminium hydroxide, aragonite, barium sulphate dolomite, magnesium hydroxide, magnesium carbonate, magnesite titanium dioxide (e.g. rutile and/or anatase), satin white, zinc oxide, silica, alumina trihydrate, mica, diatomaceous earth, aragonite, calcite, vaterite, talc and mixtures thereof. Further, plastic pigments can be present in the coating compositions. Examples of plastic pigments are polystyrene latexes where the amount of polystyrene is about 70 percent to about 100 percent of the total weight of the plastic pigment.

In some embodiments, the pigment used in the water vapor barrier layers can be a clay. Inclusion of clay can serve to, among other things, improve barrier properties, reduce blocking, and reduce the total cost of the coating composition for the water vapor barrier layers. Possible effects from the addition of clay to the water vapor barrier layers include, but are not limited to, a sealing effect on the surface of the water vapor barrier layer, a reduction in the portion of permeable material in the water vapor barrier layer, and/or increasing the diffusion path for water vapor molecules, and thus delaying their penetration through the water vapor barrier layer. Further, the water vapor barrier layers can contain other additives, such as cross-linkers, waxes, dispersants, and/or plasticizers to enhance the barrier properties, recyclability or flexibility.

As discussed herein, the biopolymer barrier layer of the multilayer coating can provide good OGR properties and oxygen barrier properties. For the various embodiments, the biopolymer barrier layer of the present disclosure can include a biopolymer, a plasticizer, and a pigment, among other elements.

As discussed herein, since biopolymers can form brittle coatings, coatings in the prior art have included high amounts of plasticizer to increase the flexibility of the biopolymer barrier layer. In contrast, the biopolymer barrier layer of the present disclosure includes a relatively low amount of plasticizer while still providing enough flexibility to the biopolymer barrier layer to prevent cracking when the paperboard is subjected to mechanical stresses.

For the various embodiments, the plasticizer can be present in the biopolymer barrier layer in a range of from about 2.5 to about 50 weight parts for every 100 dry weight parts of biopolymer. For the various embodiments, the plasticizer used in the biopolymer barrier layer of the present disclosure can be an ethylene acrylic acid copolymer. Examples of suitable plasticizers include those with molecular weights that range from about 50 to about 40,000.

For the various embodiments, the biopolymer can be present in the biopolymer barrier layer in an amount from about 50 percent to about 100 percent of the total weight of the biopolymer barrier layer. For the various embodiments, the biopolymer used in the biopolymer barrier layer of the present disclosure can be a starch. Alternatively, the biopolymer can be selected from a group including a starch, a modified starch, a chitosan, a polysaccharide, a protein, a gelatin, a biopolyester, and modifications and mixtures thereof. As used herein, a modified starch includes those starches that have been structurally and/or chemically modified to be different than the starch as is was structurally and/or chemically before the modification.

In various embodiments, the pigment included in the biopolymer barrier layer can be selected from a group consisting of clay, calcined clay, an exfoliated natural layered silicate, a partially exfoliated natural layered silicate, exfoliated synthetic layered silicate, a partially exfoliated synthetic layered silicate, ground calcium carbonate, precipitated calcium carbonate, calcium sulphate, aluminium hydroxide, aragonite, barium sulphate dolomite, magnesium hydroxide, magnesium carbonate, magnesite titanium dioxide (e.g. rutile and/or anatase), satin white, zinc oxide, silica, alumina trihydrate, mica, diatomaceous earth, aragonite, calcite, vaterite, talc and mixtures thereof. Further, plastic pigments can be present in the coating compositions. Examples of plastic pigments are polystyrene latexes where the amount of polystyrene is about 70 percent to about 100 percent of the total weight of the plastic pigment.

As discussed herein, in some embodiments, the pigment used in the second coating composition of the biopolymer barrier layer can be a clay. In such embodiments, the clay can have an average particle size of 97 percent smaller than 2 micrometers (μm), an aspect ratio of approximately 30, and a specific surface area of about 20 $m^2/g$. In some embodiments, the aspect ratio can range from about 30 to about 50. In addition, the clay can have a specific surface area of up to about 330 $m^2/g$. In an additional embodiment, the aspect ratio of the pigment can be greater than 30, while still having a size small enough to provide a specific surface area of up to about 330 $m^2/g$.

In some embodiments, the pigment can be present in the biopolymer barrier layer in an amount of about 10 to about 100 weight parts for every 100 dry weight parts of biopolymer.

In some embodiments, the first and second coating compositions can optionally include additional components (either in suspension or dissolved therein) for enhancing and/or producing a desired coating rheological property and/or finished coating property. Such additional components can include, but are not limited to, binders, dispersing agents, protective colloids, solvents for the colloids, sequestering agents, thickeners, humectants, lubricants, surfactants, wetting agents, crosslinkers, anti-foaming agents, and the like.

In addition, the surfactants, wetting agents, anti-foaming agents, dispersing agents, and/or leveling agents optionally included in the first and second coating compositions can be anionic, cationic, and/or nonionic. As one skilled in the art will appreciate, the amount and number of surfactants, wetting agents, anti-foaming agents, dispersing agents, and/or leveling agents added to the first and/or second coating compositions will depend on the particular compound(s) selected, but should be limited to an amount that is necessary to achieve wetting of the substrate while not compromising the performance of the dried coating. For example, in some embodiments, the surfactant amounts can be less than or equal to about 10 percent by weight of the first coating composition or the second coating composition.

The multilayer coating of the present disclosure may be used as at least one coating on a coated paperboard. For example, the multilayer coating of the present disclosure could be used as the only coating on the paperboard. In an additional embodiment, the multilayer coating of the present disclosure could be used as one of a base coat, a top coat, and/or one or more intermediate coatings between a base coat and a top coat of a coated paperboard. Therefore, the multilayer coating of the present disclosure may be incorporated with other layers that can enhance and/or produce a desired coating property.

As discussed herein, the multilayer structure of the present disclosure can be used for paper and/or non-paper coating applications that require barrier properties such as, for example, a water barrier and/or a moisture barrier in food packaging.

EXAMPLES

Various aspects of the present disclosure are illustrated, but not limited, by the following examples. It is to be understood that the particular examples, materials, amounts, and procedures are to be interpreted broadly in accordance with the scope of the disclosure as set forth herein. Unless otherwise indicated, all parts and percentages are by weight and all molecular weights are number average molecular weight. Unless otherwise specified, all instruments and chemicals used are commercially available as indicated herein. The following materials are used in the examples.

- Clay: Contour Xtreme Clay (Imerys Pigments for Paper), having an average particle size of 97 percent <2 μm and an aspect ration of approximately 30, with a specific surface area of 20 meters squared per gram ($m^2/g$).
- Starch: Perlcoat 155 starch (Lyckeby Starkelsen Group, Sweden Company).
- Plasticizer: Tecseal E799-35 (Trueb Emulsions Chemie AG, Switzerland). Latex DL 930 (The Dow Chemical Company, Midland Mich., USA
- Emulsifier: Emulsogen SF 8 (Clairant Chemical Company).
- Paper Based Substrate: Coated natural kraft paper board with higher flexibility with a thickness of 340 μm and a PPS roughness of 3.5 μm.

The oil used is Canola oil.

All measurements and procedures for the Examples are conducted at room temperature of about 23 degrees Celsius (° C.), unless indicated otherwise.

Coating Compositions and Coated Paper Based Substrates

Preparation of the Water Vapor Barrier Layer Coating Composition F1

The water vapor barrier layer coating composition is prepared by combining 0.5 grams (g) dry weight of Emulsogen SF 8 (about 50 percent solids) and 100 g dry weight of DL 930 latex (about 50 percent solids). This coating composition is referred to in the following tables as F1.

Preparation of the Biopolymer Barrier Layer Coating Composition F2

The biopolymer barrier layer coating composition is prepared by combining 100 g dry weight of Contour Xtreme Clay (about 68.4 percent solids), 100 g dry weight of Perlcoat 155 starch (about 32.0 percent solids), and 2.5 g dry weight of Tecseal E799-35 (about 35.0 percent solids). This coating composition is referred to in the following tables as F2.

Preparation of the Biopolymer Barrier Layer Coating Composition F3

The biopolymer barrier layer coating composition is prepared with 100 g dry weight of Perlcoat 155 starch (about 32.0 percent solids) and 2.5 g dry weight of Tecseal E799-35 (about 35.0 percent solids). This coating composition is referred to in the following tables as F3.

Preparation of the Water Vapor Barrier Layer Coating Composition F4

The water vapor barrier layer coating composition is prepared by combining 100 g dry weight of Contour Xtreme Clay (about 68.4 percent solids) 100 g dry weight of DL 930 latex (about 50 percent latex), and 0.50 g dry weight of Emulsogen SF8 (about 50 percent solids). This coating composition is referred to in the following tables as F4.

Multilayer Curtain Coating Settings

For the following Examples the coating compositions are coated onto the surface of coated natural kraft paper board (the paper substrate) to form a "coated base paper." A laboratory Multi Layer Curtain Coating (MLCC) station coater is used for the coating, and adjustments are made to obtain the desired dry coat weight for each sample. The laboratory MLCC station coater has an 8 layer slide die, a speed of 100 to 2000 meters per minute (m/min), a width of 280 millimeters (mm), and infrared (IR) and airfoils for drying.

Preparation of Samples 1-7

Each Sample of the coated base paper consists of the paper substrate, an under layer, two middle layers and a top layer or coating. The under layer and top layer are formed using the water vapor barrier layer coating composition F1, and the middle layers are formed using the biopolymer barrier layer composition F2. The under layer correlates to the first water vapor barrier layer, the middle layer(s) correlate to the biopolymer barrier layer (e.g. first and second biopolymer barrier layer, or the single biopolymer barrier layer), and the upper layer correlates to the second water vapor barrier layer. In the examples, the coating compositions used to form the layers remain constant and the dry coat weights of the various layers change. The Samples are coated with the laboratory MLCC station coater.

Sample 1

TABLE 1

Sample 1 with biopolymer barrier layers of 3 $g/m^2$ each and water vapor barrier layers of 5 $g/m^2$

| | Composition | | | |
|---|---|---|---|---|
| | F1 | F2 | F2 | F1 |
| | Name of Sample Sample 1 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight ($g/m^2$) | 5 | 3 | 3 | 5 |

Sample 2

TABLE 2

Sample 2 with biopolymer barrier layers of 3 $g/m^2$ and a variation of the water vapor barrier layers with the under layer at 5 $g/m^2$ and the top layer at 10 $g/m^2$

| | Composition | | | |
|---|---|---|---|---|
| | F1 | F2 | F2 | F1 |
| | Name of Sample Sample 2 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight ($g/m^2$) | 5 | 3 | 3 | 10 |

Sample 3

TABLE 3

Sample 3 with biopolymer barrier layers of 2 $g/m^2$ each and water vapor barrier layers of 3 $g/m^2$

| | Composition | | | |
|---|---|---|---|---|
| | F1 | F2 | F2 | F1 |
| | Name of Sample Sample 3 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight ($g/m^2$) | 3 | 2 | 2 | 3 |

Sample 4

TABLE 4

Sample 4 with biopolymer barrier layers of 3 $g/m^2$ and a variation of the water vapor barrier layers with the under layer at 10 $g/m^2$ and the top layer at 5 $g/m^2$

| | Composition | | | |
|---|---|---|---|---|
| | F1 | F2 | F2 | F1 |
| | Name of Sample Sample 4 | | | |
| Layers | Under Layer | Middle Layer | Middle Layer | Top Layer |
| Contour Xtreme Clay | | 100 g | 100 g | |
| Perlcoat 155 starch | | 100 g | 100 g | |

TABLE 4-continued

| Sample 4 with biopolymer barrier layers of 3 g/m$^2$ and a variation of the water vapor barrier layers with the under layer at 10 g/m$^2$ and the top layer at 5 g/m$^2$ | | | | |
|---|---|---|---|---|
| | Composition | | | |
| | F1 | F2 | F2 | F1 |
| | Name of Sample Sample 4 | | | |
| Layers | Under Layer | Middle Layer | Middle Layer | Top Layer |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 10 | 3 | 3 | 5 |

Sample 5

TABLE 5

| Sample 5 with biopolymer barrier layers of 3 g/m$^2$ each and water vapor barrier layers of 3 g/m$^2$ each | | | | |
|---|---|---|---|---|
| | Composition | | | |
| | F1 | F2 | F2 | F1 |
| | Name of Sample Sample 5 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 3 | 3 | 3 | 3 |

Sample 6

TABLE 6

| Sample 6 with biopolymer barrier layers of 5 g/m$^2$ and water vapor barrier layers at 5 g/m$^2$ each | | | | |
|---|---|---|---|---|
| | Composition | | | |
| | F1 | F2 | F2 | F1 |
| | Name of Sample Sample 6 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 5 | 5 | 5 | 5 |

Sample 7

TABLE 7

| Sample 7 with biopolymer barrier layers at 10 g/m$^2$ each and water vapor barrier layers at 3 g/m$^2$ each | | | | |
|---|---|---|---|---|
| | Composition | | | |
| | F1 | F2 | F2 | F1 |
| | Name of Sample Sample 7 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 10 | 3 | 3 | 10 |

Samples 8-15

To further analyze the effects of the location of the clay, the following Samples are prepared. Each Sample of the coated base paper consists of a paper substrate, an under layer, one or two middle layers, and a top layer of formed with the coating compositions to form the coated base papers. The under layer and top layer are formed with the water vapor barrier layer coating compositions F1 or F4, discussed above. The middle layer(s) is formed with the biopolymer barrier layer coating composition F2 or F3, from above. In the examples, the layers formed with the coating compositions remain constant and the dry coat weights of the various layers change. The Samples are coated with the laboratory MLCC station coater as discussed herein.

Sample 8

TABLE 8

| Sample 8 with two water vapor barrier layers at 6 g/m$^2$ each | | |
|---|---|---|
| | Composition | |
| | F1 | F1 |
| | Name of Sample Sample 8 | |
| Layers | Under Layer | Top Layer |
| Contour Xtreme Clay | | |
| Perlcoat 155 starch | | |
| Tecseal E799-35 | | |
| DL930 | 100 g | 100 g |
| Emulsogen SF8 | 0.5 g | 0.5 g |
| Dry coat weight (g/m$^2$) | 6 | 6 |

Sample 9

TABLE 9

Sample 9 with one biopolymer barrier layer at 4 g/m$^2$ and a water vapor barrier layers at 3 g/m$^2$

| | Composition | | |
|---|---|---|---|
| | F1 | F2 | F1 |
| | Name of Sample Sample 9 | | |
| Layers | Under Layer | Middle Layer | Top Layer |
| Contour Xtreme Clay | | 100 g | |
| Perlcoat 155 starch | | 100 g | |
| Tecseal E799-35 | | 2.5 g | |
| DL930 | 100 g | | 100 g |
| Emulsogen SF8 | 0.5 g | | 0.5 g |
| Dry coat weight (g/m$^2$) | 3 | 4 | 3 |

Sample 10

TABLE 10

Sample 10 with biopolymer barrier layers at 2 g/m$^2$ each and water vapor barrier layers at 3 g/m$^2$

| | Composition | | | |
|---|---|---|---|---|
| | F1 | F2 | F2 | F1 |
| | Name of Sample Sample 10 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 3 | 2 | 2 | 3 |

Sample 11

TABLE 11

Sample 11 with biopolymer barrier layers at 2 g/m$^2$ each and water vapor barrier layers at 5 g/m$^2$ each

| | Composition | | | |
|---|---|---|---|---|
| | F1 | F2 | F2 | F1 |
| | Name of Sample Sample 11 | | | |
| Layers | Under Layer | Middle Layer | Middle Layer | Top Layer |
| Contour Xtreme Clay | | 100 g | 100 g | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 5 | 2 | 2 | 5 |

Sample 12

TABLE 12

Sample 12 with biopolymer barrier layers at 2 g/m$^2$ each and water vapor barrier layers at 3 g/m$^2$ each

| | Composition | | | |
|---|---|---|---|---|
| | F1 | F3 | F3 | F1 |
| | Name of Sample Sample 12 | | | |
| Layers | Under Layer | Middle Layer | Middle Layer | Top Layer |
| Contour Xtreme Clay | | | | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 3 | 2 | 2 | 3 |

Sample 13

TABLE 13

Sample 13 with biopolymer barrier layers at 6 g/m$^2$ each.

| | Composition | |
|---|---|---|
| | F4 | F3 |
| | Name of Sample Sample 13 | |
| Layers | Under Layer | Top Layer |
| Contour Xtreme Clay | 100 g | |
| Perlcoat 155 starch | | |
| Tecseal E799-35 | | |
| DL930 | 100 g | 100 g |
| Emulsogen SF8 | 0.5 g | 0.5 g |
| Dry coat weight (g/m$^2$) | 6 | 6 |

Sample 14

TABLE 14

Sample 14 with biopolymer barrier layers at 2 g/m$^2$ each and water vapor barrier layers at 3 g/m$^2$ each, but using F4 as the under layer.

| | Composition | | | |
|---|---|---|---|---|
| | F4 | F3 | F3 | F1 |
| | Name of Sample Sample 14 | | | |
| Layers | Under Layer | Middle Layer | Middle Layer | Top Layer |
| Contour Xtreme Clay | 100 g | | | |
| Perlcoat 155 starch | | 100 g | 100 g | |
| Tecseal E799-35 | | 2.5 g | 2.5 g | |
| DL930 | 100 g | | | 100 g |
| Emulsogen SF8 | 0.5 g | | | 0.5 g |
| Dry coat weight (g/m$^2$) | 3 | 2 | 2 | 3 |

Sample 15

TABLE 15

Sample 15 with water vapor barrier layer and biopolymer barrier layers at 6 g/m$^2$ each.

| | Composition | |
|---|---|---|
| | F4 | F3 |
| | Name of Sample Sample 15 | |
| Layers | Under Layer | Top Layer |
| Contour Xtreme Clay | 100 g | |
| Perlcoat 155 starch | | 100 g |
| Tecseal E799-35 | | 2.5 g |
| DL930 | 100 g | |
| Emulsogen SF8 | 0.5 g | |
| Dry coat weight (g/m$^2$) | 6 | 6 |

Flat Kit Test

Grease and oil kit testing liquids are made according to formulas shown in Table 16. Castor oil (USP Grade 99-100%), toluene (ACS Grade, 99.5% min. by gas chromatography), heptane (Reagent grade, 99.9% min. with 99.0% n-heptane) are purchased from VWR International.

TABLE 16

Composition of Kit Test Liquids

| | Kit # | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Castor Oil (g) | 100 | 90 | 80 | 70 | 60 | 50 | 40 | 30 | 20 | 10 | 0 | 0 |
| Toluene (g) | 0 | 5 | 10 | 15 | 20 | 25 | 30 | 35 | 40 | 45 | 50 | 45 |

TABLE 16-continued

Composition of Kit Test Liquids

| | Kit # | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Heptane (g) | 0 | 5 | 10 | 15 | 20 | 25 | 30 | 35 | 40 | 45 | 50 | 55 |

The oil and grease resistance "Kit Test" is performed on the samples of the Samples 8-14 according to TAPPI UM 557 "Repellency of Paper and Board to Grease, Oil, and Waxes (Kit Test)." The Kit Test is a procedure for testing the degree of repellency of paper or paperboard having a coating, such as the coated base paper of the present disclosure.

The Kit Test is conducted as follows. Obtain five representative samples (5.08 cm×5.08 cm) of each of the coated base papers. Deposit one drop of the Kit Rating Number test reagent onto a flat surface of the coated base paper having the coating composition of the present disclosure from a height of 2.54 cm. After 15 seconds, wipe away the excess Kit Rating Number test reagent with a clean tissue or cotton swatch. Immediately examine the surface of the coated base paper.

The coated base paper is assigned a failure if the test surface shows a pronounced darkening as compared to an untested coated base paper. If, however, the coated base paper passes, repeat the above described test with a new sample of coated base paper with the next higher Kit Rating Number test reagent until a failure Kit Rating Number test reagent is found. The average of the five highest passing Kit Rating Number test reagent rounded to the nearest 0.5 is reported as the flat Kit Rating Number for the coating composition on the coated base paper. Test results are shown in Table 17 below.

TABLE 17

Flat Kit Rating Test Results

| Sample | Flat Kit Rating Number |
|---|---|
| Sample 8 | 5 |
| Sample 9 | 12 |
| Sample 10 | 12 |
| Sample 11 | 12 |
| Sample 12 | 12 |
| Sample 13 | 5 |
| Sample 14 | 12 |

Hot Oil Circle Test

The Hot Oil Circle Test is developed by The Dow Chemical Company to evaluate the hot-oil resistance of coating compositions. The oil and grease resistance of the coated base paper is tested on a mechanically stressed samples of the coated base paper. The hot oil resistance test is conducted at 60° C. in order to accelerate the oil penetration rate into the coated base paper. The testing procedure is as follows.

Collect samples of the coated base paper (8 cm×8 cm). A minimum of two samples per test is required. A creasing procedure is used to form a crease in the coated paper, which forms the mechanically stressed samples of the coated base paper. The creasing procedure is performed with a lab creasing device (Marbach Werkzeugbau). FIG. 1 illustrates portions of the lab creasing device 100 used in forming the crease coated base paper samples of the present test. The crease height ($H_c$) formed with the lab creasing device 100 is calculated using the following formula.

$$H_c = H_{cutter} - H_{bar} - s^*$$

where $H_c$ represents the height of the creaser 104;

$H_{cutter}$ represents the height of the cutter 106;

$H_{bar}$ represents the height of the counterplate 108 under the creaser 104; and s* represents the thickness of the coated base paper in its mechanically stressed state.

(Information from "Praktikumsversuch Nr. 2: Stanzen, Rillen, and Falten von Faltschachtel Karton" Prof. Hofer of Univerisity of Applied Science, Munich.)

The lab creasing device 100 has an $H_{cutter}$ equal to 23.8 mm and an $H_{bar}$ equal to 0.1 mm. The value of s* is equal to (s)(1−p), where s is the thickness of the coated base paper sample having a value of approximately 0.37 mm, and p is a compression value for the coated base paper sample 102. The value for p depends on the compressibility of the coated base paper sample 102, where to avoid destruction of the sample 102 in the lab creasing device 100 a value of p=0.1 is chosen. For the present examples, the height of the creaser 104 is calculated to be 23.35 mm.

In order to effectively crease the coated paper samples, a crease height is used to calculate which creasing dressing can be used to crease the coated paper samples without cutting the samples. In addition, the calculation of a counterplate is necessary to avoid cutting the sample and to produce defined creases that are reproducible. For the choice of the creasing dressing, the effective width of the depression, $b_N$ and depression in the counterplate, $t_N$ are determined. As guide values for $b_N$ and $t_N$ the following can be assumed:

$$b_N=1.5\times s+b_M \qquad \text{Machine direction of the paper (MD):}$$

$$b_N=1.5\times s+b_M+0.1\text{ m} \qquad \text{Cross direction of the paper (CD):}$$

where s is the thickness of the coated based paper; and $b_M$ is the width of the creaser 104, which has a value of 0.7 mm.

Once the MD $b_N$, and CD $b_N$ are calculated, the two can be used to select the appropriate creasing dressing, Nr. Using Table 18 below, the Nr is chosen where the $b_N$ value is equal to $b_{N2}$. For example, if $b_N$ is equal to 1.2, an Nr equal to 1 is used, if $b_N$ is equal to 1.3, an Nr equal to 3 is used. In addition, by using Table 18 to determine the Nr to use from the $b_N$, the $t_N$ is also provided. With this method, creasing is defined and gives reproducible results.

TABLE 18

Available creasing dressings

| Nr | $t_N$ (mm) | $b_{N1}$ (mm) | $b_{N2}$ (mm) | $b_{N3}$ (mm) | $b_{N4}$ (mm) |
|---|---|---|---|---|---|
| 1 | 0.40 | 1.10 | 1.20 | 1.30 | 1.40 |
| 2 | 0.40 | 1.40 | 1.50 | 1.60 | 1.70 |
| 3 | 0.45 | 1.20 | 1.30 | 1.40 | 1.50 |
| 4 | 0.50 | 1.30 | 1.40 | 1.50 | 1.60 |
| 5 | 0.50 | 1.50 | 1.60 | 1.70 | 1.80 |
| 6 | 0.55 | 1.50 | 1.60 | 1.70 | 1.80 |
| 7 | 0.60 | 1.40 | 1.50 | 1.60 | 1.70 |
| 8 | 0.60 | 1.90 | 2.00 | 2.10 | 2.20 |

In this case the calculated effective width and height of the creasing dressing is: s, or $t_N$, is equal to 0.37 mm, $b_M$ is equal to 0.7, $b_N$ (CD) is equal to 1.348 mm, and $b_N$ (MD) is equal to 1.248 mm. Due to the sample thickness of 0.37 mm, Nr equal to 1 or 2 are the only options. However, the average $b_N$ value is equal to 1.298, using the average of $b_N$ (CD) and $b_N$ (MD), therefore since Nr equal to 1 includes a $b_N$ value closest to 1.298, the Nr is equal to 1.

Once the coated base paper samples have been creased, the creased base paper samples are folded, unfolded, and taped (e.g., in a flat state) onto Plexiglas® with the coated side of the coated base paper facing up. A circle template is used to draw a 6.0 cm diameter circle around the middle of the creased coated base paper samples. A hot glue gun is then used to deposit a bead of glue along the circle to create a "glue dam." The glue dam is allowed to cool and harden for a minimum of 15 minutes at room temperature.

Pre-heated canola oil is removed from an oven at 60° C., and 1 ml is applied to the initially creased and folded coated base paper in the area defined by the glue dam. It is necessary that the oil spreads to cover the entire circle. A picture is taken of the oil-covered sample to help with interpretation of results. The oil-covered sample is then placed into the oven at 60° C. After a scheduled time interval (here, after 11 hours), the samples of the creased coated base paper are removed from the oven and placed on a lab bench to cool to room temperature. Pictures of the creased coated base paper samples are taken with and without oil. The results for some of the Samples are shown in Tables 19 and 20.

TABLE 19

Sample Oil and Grease Penetration Data for Creased Coated Base Paper Samples 1-6

| | Oil Penetration | No Oil Penetration | Number of Tests |
|---|---|---|---|
| Sample 1 | 7 | 1 | 8 |
| Sample 2 | 8 | | 8 |
| Sample 3 | | 8 | 8 |
| Sample 4 | 5 | | 5 |
| Sample 5 | 4 | 4 | 8 |
| Sample 6 | 8 | | 8 |
| Total Samples | | | 45 |

Samples 1-6 show that only 13 of the 45 creased samples show no penetration of hot oil after 24 hours. Only the multilayer structure with the lowest total dry coat weight (Sample 3 creased) passed the test by 100 percent. Below is the statistical information for Samples 1-6.

TABLE 20

Statistical Data for Sample Oil & Grease Penetration Data For Creased Coated Base Paper Samples

| Name | n | Mean (μ) | Standard deviation (δ) | Confidence interval for μ (95%) | | Confidence Interval for δ (98%) | |
|---|---|---|---|---|---|---|---|
| Sample 1 | 8 | 7.875 | 0.365 | 7.57 | 8.18 | 0.28 | 0.87 |
| Sample 2 | 8 | 8 | 0 | 8 | | 0 | |
| Sample 3 | 8 | 7 | 0 | 7 | | 0 | |
| Sample 4 | 5 | 8 | 0 | 8 | | 0 | |
| Sample 5 | 8 | 7.5 | 0.535 | 7.05 | 7.95 | 0.41 | 1.27 |
| Sample 6 | 8 | 8 | 0 | 8 | | 0 | |

The above described Hot Oil Circle test is also performed on Samples 8-15. The results are shown in Tables 21 and 22.

TABLE 21

Sample Oil and Grease Penetration Data for Creased Coated Base Paper Samples 8-15

| | Oil Penetration | No Oil Penetration | Number of Tests |
|---|---|---|---|
| Sample 8 | 16 | | 16 |
| Sample 9 | 3 | 13 | 16 |

TABLE 21-continued

| Sample Oil and Grease Penetration Data for Creased Coated Base Paper Samples 8-15 | | | |
|---|---|---|---|
| | Oil Penetration | No Oil Penetration | Number of Tests |
| Sample 10 | | 16 | 16 |
| Sample 11 | 4 | 12 | 16 |
| Sample 15 | 12 | | 12 |
| Sample 12 | 3 | 13 | 16 |
| Sample 13 | 11 | 1 | 12 |
| Sample 14 | 15 | 1 | 15 |
| Uncoated | 8 | | 8 |
| Total Samples | | | 127 |

Samples 8-15 show that 56 of the 127 samples pass the oil and grease test without penetration. The samples with good oil and grease resistance after creasing are Samples 10, 12, and 11. Below is the statistical information for the tests (Samples 8-15).

TABLE 22

| Main Trial Test Statistical information | | | | | | | |
|---|---|---|---|---|---|---|---|
| Name | n | Mean (μ) | Standard deviation (δ) | Confidence interval for μ (95%)* | | Confidence Interval for δ (98%) | |
| Sample 8 | 16 | 8 | 0 | 8 | | 0 | |
| Sample 9 | 16 | 7.19 | 0.40 | 6.98 | 7.4 | 0.28 | 0.68 |
| Sample 10 | 16 | 7 | 0 | 7 | | 0 | |
| Sample 11 | 16 | 7.25 | 0.45 | 7.01 | 7.49 | 0.32 | 0.76 |
| Sample 15 | 12 | 8 | 0 | 8 | | 0 | |
| Sample 12 | 16 | 7.19 | 0.40 | 6.98 | 7.4 | 0.28 | 0.68 |
| Sample 13 | 12 | 7.92 | 0.29 | 7.74 | 8.10 | 0.17 | 0.55 |
| Sample 14 | 16 | 7.93 | 0.26 | 7.79 | 8.07 | 0.20 | 0.44 |
| Uncoated board | 8 | 8 | 0 | 8 | | 0 | |

*Assumption: Normal distribution of OGR, independent samples

Oxygen Transmission Rate Testing

The oxygen transmission rate measurement is performed on Samples 8-14. The oxygen permeability is measured using a measuring apparatus (Model OX-TRAN Model 2/21, manufactured by Mocon, Inc.) at a temperature of 23° C. and a relative humidity (RH) of 50 percent. Within this instrument, each measurement unit is composed of two cells, which are separated by the sample. In one cell carrier gas (nitrogen) is routed, where the other cell is flushed with a test gas (oxygen). Both gases have a defined temperature and RH. After the measurement is started, oxygen is allowed to enter the Coulox sensor. This sensor, when exposed to oxygen, generates an electrical current which is proportional to the amount of oxygen entered. The results for the oxygen transmission test are presented in Table 23.

TABLE 23

| Results of Oxygen Transmission Measurement of Samples of Main Trial | | | |
|---|---|---|---|
| Sample | Number of repetitions of dependent pairs | Transmission Rate [cc/(m$^2$ * day)] | Standard deviation [cc/(m$^2$ * day)] |
| Sample 8 | 1 | Measurement failed, >200 | — |
| Sample 8 † | 2 | Measurement failed, >1000 | — |
| Sample 9 | 2 | 23 | 1 |
| Sample 10 | 2 | 40 | 2 |
| Sample 11 | 2 | 34 | 0 |

TABLE 23-continued

| Results of Oxygen Transmission Measurement of Samples of Main Trial | | | |
|---|---|---|---|
| Sample | Number of repetitions of dependent pairs | Transmission Rate [cc/(m$^2$ * day)] | Standard deviation [cc/(m$^2$ * day)] |
| Sample 12 | 2 | 68 | 7 |
| Sample 13 | 1 | Measurement failed, >200 | — |
| Sample 14 | 1 | Measurement failed, >200 | — |
| Sample 14 † | 2 | 672 | 243 |

† Measurement was done with a lower oxygen concentration.

The data provided in Table 23 illustrates that the multilayer coatings of Samples 8, 13, and 14 are not effective as oxygen barrier layers as compared with the multilayer coatings of Samples 9-12. In comparing the multilayer coating of Sample 14 to the multilayer coatings of Samples 10 and 12, the biopolymer layers that included both starch and clay (Samples 10 and 12) have superior oxygen barrier properties, indicating that the presence of clay improves the oxygen barrier properties of the multilayer coating. In addition, the multilayer coating of Samples 8-15 have good flexibility as shown by their performance in the Hot Oil Circle test discussed above.

What is claimed:

1. A coated paper or paperboard, comprising:

a base paper having a first major surface;

a multilayer coating over the first major surface, where the multilayer coating has a total dry coat weight of 10 g/m$^2$ or less and includes:

a first water vapor barrier layer formed with a synthetic latex;

a biopolymer barrier layer on the first water vapor barrier layer, where the biopolymer barrier layer includes a first biopolymer barrier layer on the first vapor water barrier layer and a second biopolymer barrier layer on the first biopolymer barrier layer so that the first biopolymer barrier layer and the second biopolymer barrier layer are between the first barrier layer and the second barrier layer, and wherein each of the first biopolymer barrier layer and the second biopolymer barrier layer have a dry coat weight of 2 g/m$^2$ or less, and wherein the biopolymer barrier layer includes a biopolymer and 2.5 to about 50 weight parts of a plasticizer for every 100 dry weight parts of the biopolymer;

a second water vapor barrier layer on the biopolymer barrier layer, where the second water vapor barrier layer is formed with a latex, wherein the biopolymer barrier layer is positioned between the first water vapor barrier layer and the second water vapor barrier layer to protect the biopolymer barrier layer from water absorption; and where the coated paper or paper board has a Kit Rating Number of at least 12 and prevents penetration of canola oil at 60° C. for 24 hours through the multilayer coating and the base paper after creasing and folding.

2. The coated paper or paperboard of claim 1, where the plasticizer is an ethylene-acrylic acid copolymer.

3. The coated paper or paper board of claim 1, where the first water vapor barrier layer and the second water vapor barrier layer has a combined dry coat weight of 6 g/m$^2$ or less and each of the first water vapor barrier layer and the second water vapor barrier layer is formed with a coating composition that consists of the latex, an emulsifier and about 0 to about 100 weight parts pigment for every 100 dry weight parts of latex.

4. The coated paper or paper board of claim 1, where the coated paper or paper board has an oxygen permeability of not higher than 100 $cm^3/(m^2*24$ hours) at 23° C., 760 mmHg, and 50% relative humidity.

5. The coated paper or paperboard of claim 1, where the synthetic latex of the first water vapor barrier layer is selected from a group including styrene-butadiene latexes, styrene-acrylate latexes, styrene-acrylic latexes, styrene maleic anhydrides, styrene-butadiene acrylonitrile latexes, styrene-acrylate-vinyl acrylonitrile latexes, vinyl acetate latexes, vinyl acetate-butyl acrylate latexes, vinyl acetate-ethylene latexes, acrylic latexes, vinyl acetate-acrylate latexes, acrylate copolymers, vinylidene-containing latexes, vinylidene chloride latexes, vinyl chloride containing latexes, and a mixtures thereof.

6. The coated paper or paperboard of claim 1, where the second water vapor barrier layer is formed with a synthetic latex.

7. The coated paper or paperboard of claim 1, where the biopolymer barrier layer includes about 10 to about 100 weight parts of a pigment for every 100 dry weight parts of biopolymer.

8. The coated paper or paperboard of claim 7, where the biopolymer is selected from the group consisting of a starch, a modified starch, a chitosan, a polysaccharide, a protein, a gelatin, a bio-polyesters and modifications and mixtures thereof.

9. The coated paper or paperboard of claim 7, where the pigment is a selected from the group consisting of a clay, an exfoliated natural layered silicate, a partially exfoliated natural layered silicate, an exfoliated synthetic layered silicate, a partially exfoliated synthetic layered silicate, calcium carbonates, talc and mixtures thereof.

10. A method of forming a coated paper or paper board, comprising:

applying a multilayer coating to a first major surface of a base paper, where the multilayer coating has a total dry coat weight of 10 $g/m^2$ or less and includes:

a first water vapor barrier layer formed with a synthetic latex;

a biopolymer barrier layer on the first water vapor barrier layer, where the biopolymer barrier layer includes a first biopolymer barrier layer on the first vapor water barrier layer and a second biopolymer barrier layer on the first biopolymer barrier layer so that the first biopolymer barrier layer and the second biopolymer barrier layer are between the first barrier layer and the second barrier layer, and wherein each of the first biopolymer barrier layer and the second biopolymer barrier layer have a dry coat weight of 2 $g/m^2$ or less, and wherein the biopolymer barrier layer includes a biopolymer and 2.5 to about 50 weight parts of a plasticizer for every 100 dry weight parts of the biopolymer;

a second water vapor barrier layer on the biopolymer barrier layer, where the second water vapor barrier layer is formed with a latex, wherein the biopolymer barrier layer is positioned between the first water vapor barrier layer and the second water vapor barrier layer to protect the biopolymer barrier layer from water absorption; and drying the multilayer coating on the first major surface of the base paper, where the coated paper or paper board has a Kit Rating Number of at least 12 and prevents penetration of canola oil at 60° C. for 24 hours through the multilayer coating and the base paper after creasing and folding.

11. The method of claim 10, where applying a multilayer coating includes applying each of the first and second water vapor barrier layers to form the first barrier layer having a coat weigh of 3 $g/m^2$ or less, and to form the second water vapor barrier layer having a coat weigh of 3 $g/m^2$ or less, where each of the first water vapor barrier layer and the second water vapor barrier layer is formed with a coating composition that consists of the latex, an emulsifier and about 0 to about 100 weight parts pigment for every 100 dry weight parts of latex.

12. The method of claim 10, where each of the at least one biopolymer barrier layer is formed from a second coating composition that includes:

about 10 to about 100 weight parts of a pigment for every 100 dry weight parts of biopolymer.

13. The method of claim 10, where applying the multilayer coating to the first major surface of the base paper includes simultaneously applying the multilayer coating to the first major surface of the base paper.

14. A coated paper or paperboard formed by the method of claim 10.

15. The method of claim 10, where applying a multilayer coating includes applying the first and second water vapor barrier layers and at least one biopolymer barrier layer to form the multilayer coating having a total dry coat weight of 10 $g/m^2$ or less.

16. The method of claim 15, where applying a multilayer coating includes applying at least one biopolymer barrier layer to form a biopolymer barrier layer having a total dry coat weigh of 4 $g/m^2$ or less.

17. The method of claim 10, where applying the multilayer coating includes applying a first biopolymer barrier layer on a first water barrier layer, and a second biopolymer barrier layer on the first biopolymer barrier layer so that the first biopolymer barrier layer and the second biopolymer barrier layer are between the first barrier layer and the second barrier layer.

18. The method of claim 17, where each of the first biopolymer barrier layer and the second biopolymer barrier layer have a dry coat weight of 2 $g/m^2$ or less.

* * * * *